US007806229B2

(12) United States Patent
Dyck et al.

(10) Patent No.: US 7,806,229 B2
(45) Date of Patent: Oct. 5, 2010

(54) FAN POWERED SILENCING TERMINAL UNIT

(75) Inventors: Alfred Theodor Dyck, Winnipeg (CA); Duane McLennan, Winnipeg (CA); James William Patterson, Chicago, IL (US); Johann Joel Emile Baetsen, Winnipeg (CA); Bogna Gryc, East S. Paul (CA)

(73) Assignee: E.H. Price Ltd. (CA)

( * ) Notice: Subject to any disclaimer, the term of this patent is extended or adjusted under 35 U.S.C. 154(b) by 78 days.

(21) Appl. No.: 12/047,816

(22) Filed: Mar. 13, 2008

(65) Prior Publication Data

US 2008/0271945 A1 Nov. 6, 2008

Related U.S. Application Data

(60) Provisional application No. 60/895,152, filed on Mar. 16, 2007.

(51) Int. Cl.
*E04F 17/04* (2006.01)

(52) U.S. Cl. ..... 181/225; 181/224

(58) Field of Classification Search ..... 181/224, 181/225; 454/338
See application file for complete search history.

(56) References Cited

U.S. PATENT DOCUMENTS 2,950,776 A * 8/1960 Stephens ..... 181/224
3,018,840 A * 1/1962 Bourne et al. ..... 181/224
3,033,307 A * 5/1962 Sanders et al. ..... 181/224
3,507,356 A * 4/1970 Smith ..... 181/224
3,511,336 A * 5/1970 Rink et al. ..... 181/224
3,568,791 A * 3/1971 Luxton ..... 181/224
3,642,093 A * 2/1972 Schach ..... 181/239
3,841,434 A * 10/1974 Culpepper, Jr. ..... 181/224
4,236,597 A * 12/1980 Kiss et al. ..... 181/224
4,287,962 A * 9/1981 Ingard et al. ..... 181/224
5,728,979 A * 3/1998 Yazici et al. ..... 181/224
5,869,792 A * 2/1999 Allen et al. ..... 181/224
5,983,888 A * 11/1999 Anselmino et al. ..... 126/299 R
6,342,005 B1 * 1/2002 Daniels et al. ..... 454/338
6,402,612 B2 * 6/2002 Akhtar et al. ..... 454/186
6,419,576 B1 * 7/2002 Han ..... 454/338
6,640,926 B2 * 11/2003 Weinstein ..... 181/224
6,802,690 B2 * 10/2004 Han et al. ..... 415/119

FOREIGN PATENT DOCUMENTS

DE 3401210 A1 * 7/1985

* cited by examiner

*Primary Examiner*—Jeffrey Donels
*Assistant Examiner*—Jeremy Luks
(74) *Attorney, Agent, or Firm*—Smith, Gambrell & Russell

(57) ABSTRACT

An apparatus and method for attenuating the sound generated by a fan powered terminal unit in an HVAC (heating, ventilating, and air conditioning) system. The apparatus utilizes internal geometry to minimize noise due to air disturbances and aerodynamic effects within the apparatus.

5 Claims, 9 Drawing Sheets

110
109
108
107
106
105
104
102
103
101
100
305
351
352
354
353

403
402
405

4C
4C 407
404
4D
4D
409
408
402
406
401
401

407
451
452
453
454
505
551
552
553
554

5C
5C
5D
5D
503
504
505
502
501
501

6C
6C
6D
6D
602
604
603
605
601
601

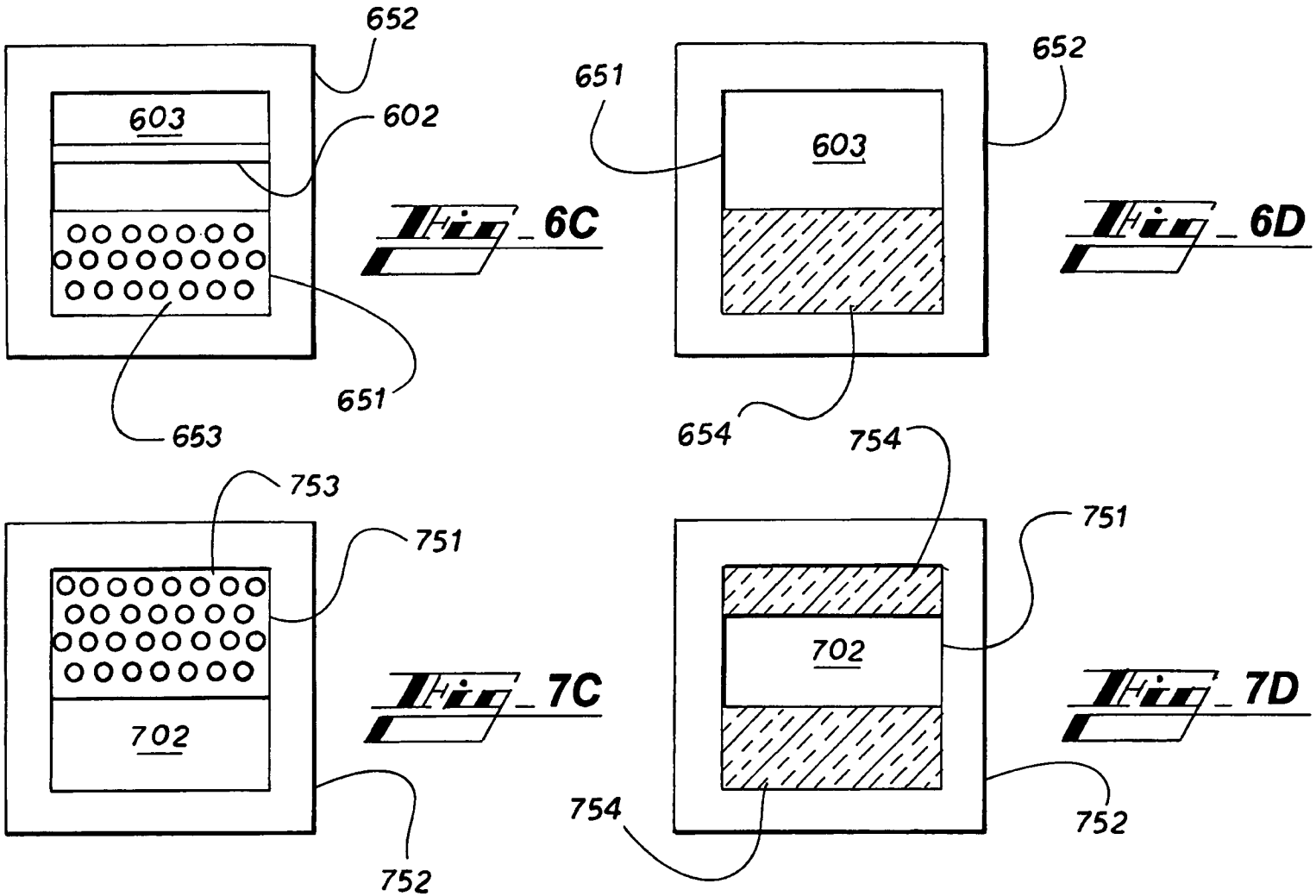
6D
652
603
654
651
6C
652
602
651
603
653
7D
751
752
754
702
754
7C
751
752
753
702

7C
7C
7D
7D
704
702
705
703
701
701

FAN POWERED SILENCING TERMINAL UNIT

CROSS REFERENCES TO RELATED APPLICATIONS

This application claims priority to U.S. Provisional Application No. 60/895,152, filed Mar. 16, 2007, which is incorporated herein by reference.

FIELD OF THE INVENTION

This invention relates to an integrated fan powered silencing terminal unit for HVAC (heating, ventilating, and air conditioning) systems.

BACKGROUND OF THE INVENTION

Commercial HVAC systems have contained "Fan Powered Terminal Units" ("FPTUs") for the purpose of providing an outlet for commercial ventilation systems into the rooms of a building or other structure equipped with an HVAC system. A FPTU typically consists of the following components: 1) centrifugal fan, 2) motor, 3) insulated casing, and 4) air inlet (with or without damper).

In commercial HVAC installations, a "silencer" (or "attenuator") is often attached to the inlet or outlet of an FPTU in order to attenuate the sound produced by the high-velocity air entering the FPTU. Such silencers have typically comprised an air duct (typically from three to five feet in length) that is lined internally with insulation to attenuate the noise produced by the air flowing through the FPTU. Such internal insulation is also known as a "baffle" and is usually held in place by perforated sheet metal. The perforations in the metal allow the air traveling through the silencer to interact with the insulation material contained inside the baffle. The silencer is attached to the inlet or the outlet of the FPTU and acts to attenuate the noise that is produced by the FPTU. This attenuation is achieved due to the conversion of acoustic energy into heat energy as the air molecules inside the silencer create friction when they collide with the lined insulation.

The noise generated by an FPTU can be separated into two components: 1) noise due to the air disturbance created in the immediate vicinity of the rotating fan blades and 2) aerodynamic noise due to the fan-induced air flow that has variable pressure regions within the fan discharge velocity profile and the air flow interaction with geometry changes in the air stream. The insulation contained in silencers minimizes both sources of noise created by the FPTU.

The noise generated by a given FPTU can vary widely depending on how it is utilized in a particular HVAC system and on the configuration of the HVAC system. Similarly, the acoustic performance of a given silencer can also vary widely depending upon the configuration of the HVAC system in which it is installed. Such unpredictability of the noise that will be generated by an FPTU and the attenuation achieved by a silencer is known as the "system effect" of the HVAC system in which the FPTU and silencer are installed. For instance, the manner in which the distribution ductwork is organized in a given building installation can affect the turbulence and air pressures created inside the ductwork. This, in turn, can affect the noise level generated by an FPTU and the acoustic performance achieved by a silencer attached thereto.

The unpredictability produced by such system effects creates uncertainty when HVAC installers are selecting FPTUs and silencers for installation in a building. Manufacturers of traditional FPTUs and silencers typically test their products under artificial laboratory conditions and produce specifications as to the noise generated by their FPTUs and the noise attenuation achieved by their silencers. However, these specifications do not take into account the system effects produced by installing their products in an actual HVAC system. Thus, HVAC installers generally have only marginally reliable product specifications on which they can rely and often must utilize trial-and-error methods to choose the appropriate combination of FPTUs and silencers that will meet their needs in a particular HVAC installation.

SUMMARY OF THE INVENTION

The invention (a fan powered silencing terminal unit "FPSTU") involves an apparatus and method for attenuating the sound generated by a fan powered terminal unit in a predictable and consistent manner. A further object of the invention is the integration of an FPTU and a silencer into a single unit. Another object of the invention is to attenuate sound to a greater degree than is possible with a combination of prior art FPTUs or silencers of a given size.

Embodiments of the invention can minimize the noise generated by the variable pressure regions within the FPSTU unit by closely coupling the noise-attenuating, insulation-lined silencing portion of the unit to the housing of the centrifugal fan inside the unit. Such close-coupling minimizes the turbulence created by the centrifugal fan and thus minimizes the associated noise.

Embodiments of the invention also minimize noise within the FPSTU by creating a constant, uniform cross-sectional profile of the air traveling through the unit. This uniform cross-sectional profile minimizes the turbulence created when air exiting a typical FPTU enters a silencer with a larger (or smaller) cross-sectional area. The decreased turbulence in the airflow of the invention, in turn, helps minimize the noise generated by the FPSTU.

Embodiments of the invention minimize high-frequency noise due to the internal angled or curved geometry of the FPSTU. Such geometry obstructs any direct line-of-sight pathway out of the unit that would otherwise allow high-frequency noise to escape without much attenuation. Traditional silencers lack any such internal geometry and instead allow high-frequency noise to exit the silencer without contacting the baffles of the silencer. Therefore, the high-frequency noise in a traditional silencer can escape without much attenuation.

Further objects, features, and advantages will become apparent upon consideration of the following detailed description of the invention when taken in conjunction with the drawings and the appended claims.

BRIEF DESCRIPTION OF THE DRAWINGS

FIG. 6C is an end view along line 6C of FIG. 6B.

FIG. 6D is a cross-sectional view along line 6D of FIG. 6B.

FIG. 7C is an end view along line 7C of FIG. 7B.

FIG. 7D is a cross-sectional view along line 7D of FIG. 7B.

DETAILED DESCRIPTION

Figures 1, 3C, 3D:
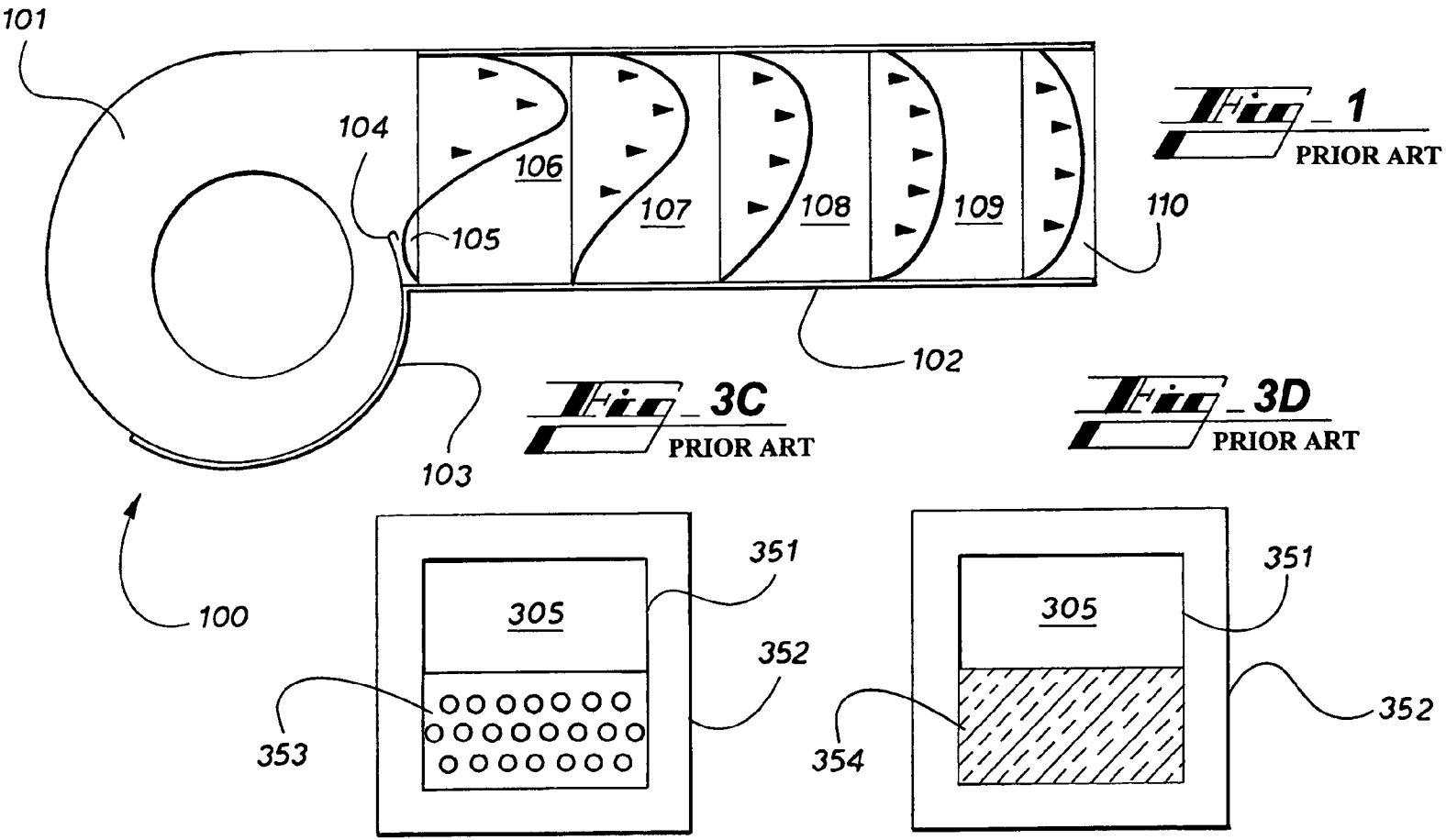
Fig. 1 PRIOR ART
Fig. 3D PRIOR ART
Fig. 3C PRIOR ART
FIG. 1 is a side elevation view of a centrifugal fan and the velocity and pressure profile of the air leaving the centrifugal fan in a prior art FPTU.
FIG. 3C is an end view along line 3C of FIG. 3B.
FIG. 3D is a cross-sectional view along line 3D of FIG. 3B.

FIG. 1 is an illustration of the velocity and pressure profile of a centrifugal fan 101 in a typical prior art FPTU 100. The centrifugal fan 101 is enclosed in a housing 103 and blows air out into a discharge duct 102 or attached silencer. The housing 103 of the fan 101 has a cutoff plate 104 on the lower edge of the housing 103. The cutoff plate 104 creates a low pressure area 105 immediately behind the cutoff plate 104. The high-velocity air exiting the fan 101 exhibits a non-uniform bulge 106 of high pressure. As the air travels down the discharge duct 102, the bulge of high pressure will gradually even out as illustrated in 107, 108, 109, and 110. The turbulence generated as the high pressure bulge gradually evens out will create noise in the FPTU 100.

Figures 2A, 2B:
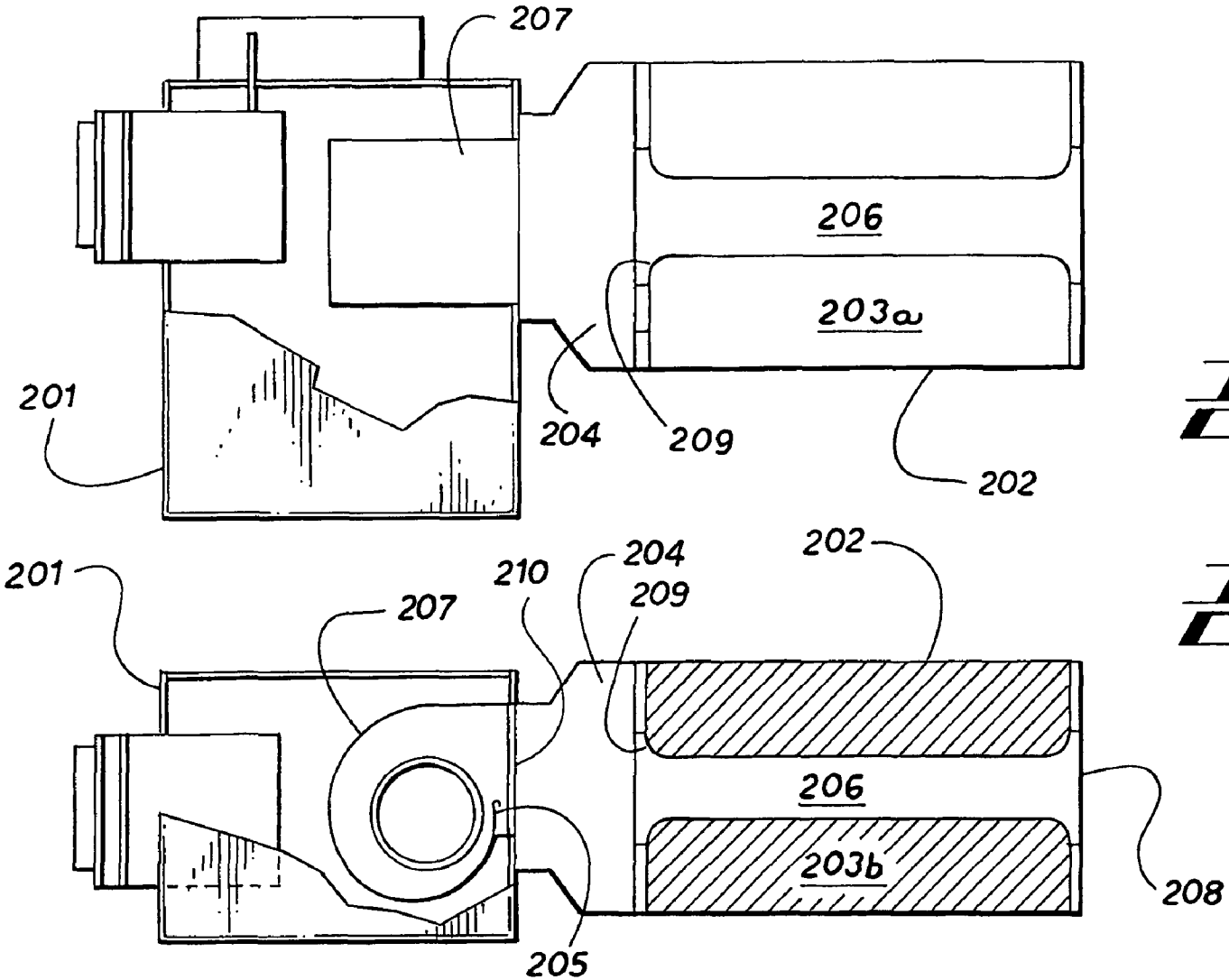
Fig. 2A PRIOR ART
Fig. 2B PRIOR ART
FIG. 2A is a top cut away view of a prior art FPTU coupled to a prior art silencer with vertical baffles.
FIG. 2B is a side cross-sectional view of a prior art FPTU coupled to a prior art silencer with horizontal baffles.

FIGS. 2A and 2B are illustrations of the close-coupling of a prior art FPTU 201 with a prior art silencer 202. Such silencers typically have vertical baffles 203*a* or horizontal baffles 203*b* (with respect to the FPTU 201) in order to attenuate the sound produced by the FPTU 201. Prior art silencers 202 typically have a wider cross-sectional area than a corresponding FPTU 201, creating a wide area 204 inside the silencer 202. This wide area 204 creates a space where turbulence can develop in the silencer 202, thus unnecessarily increasing the noise level in the silencer 202. In addition, prior art FPTUs 201 contain the cutoff plate 205 described previously, which also increases the noise generated by the FPTU 201 due to the non-uniform bulge of high pressure exiting the FPTU 201. The cross-sectional area of the blower outlet 210 of prior art FPTUs 201 is typically larger than the cross-sectional area of the air pathway 206 of prior art silencers 202. Therefore a "nose" 209 is created where the air exiting the blower outlet 210 collides into the baffles 203*a*, 203*b* inside the silencer 202. This causes added turbulence and increased noise.

Prior art FPTUs 201 and silencers 202 also have a direct line-of-sight pathway 206 from the centrifugal fan 207 of the FPTU 201 to the discharge outlet 208 of the silencer 202. As a consequence of such a direct line-of-sight pathway 206, high-frequency sounds can travel relatively unobstructed through the silencer 202. This is because the shorter wavelengths of high-frequency sound waves produce less displacement of the air molecules and hence those air molecules are less likely to collide with the baffles 203*a*, 203*b* inside the silencer 202. This "beaming" effect of high-frequency sounds thus reduces the effectiveness of prior art silencers 202 in reducing high-frequency noise.

FIGS. 3A-3D are depictions of a prior art FPTU 301 closely-coupled to a prior art silencer 304 with only a half-baffle design. That is, the silencer 304 contains a baffle 306 on only a single internal wall. This half-baffle silencer 304 still contains a nose 302 which leads to increased turbulence and noise. The nose 302 is caused because the cross-sectional air pathway 305 of the silencer 304 is narrower than the cross-sectional area of the blower outlet 303 of the FPTU 301.

FIG. 3C depicts an end view of the silencer 304 and the perforated metal casing 353 that encloses the insulating material 354 of the baffle 306. FIG. 3C also shows the casing 351 of the silencer 304 and the casing 352 of the FPTU 301.

FIG. 3D depicts a cross-sectional view of the insulating material 354 that comprises the baffle 306 of the silencer 304. FIG. 3D also shows the casing 351 of the silencer 304 and the casing 352 of the FPTU 301.

FIGS. 4A-4E depict an embodiment of an FPSTU 401 in accordance with the invention. FPSTU 401 contains a silencer inlet extension 402 which connects the top edge 403 of the baffle 409 contained in the silencing portion 404 of the FPSTU 401 directly to the cutoff plate 405 of the centrifugal fan 406 housed in the FPSTU 401. The silencer inlet extension 402 eliminates the low-pressure area 105 caused by the cutoff plate 104 in prior art FPTUs (FIG. 1). Therefore, the air exiting the centrifugal fan 406 does not contain a non-uniform bulge of high pressure as it travels down the air pathway 407 of the silencing portion 404 of the FPSTU 401.

Figure 3A:
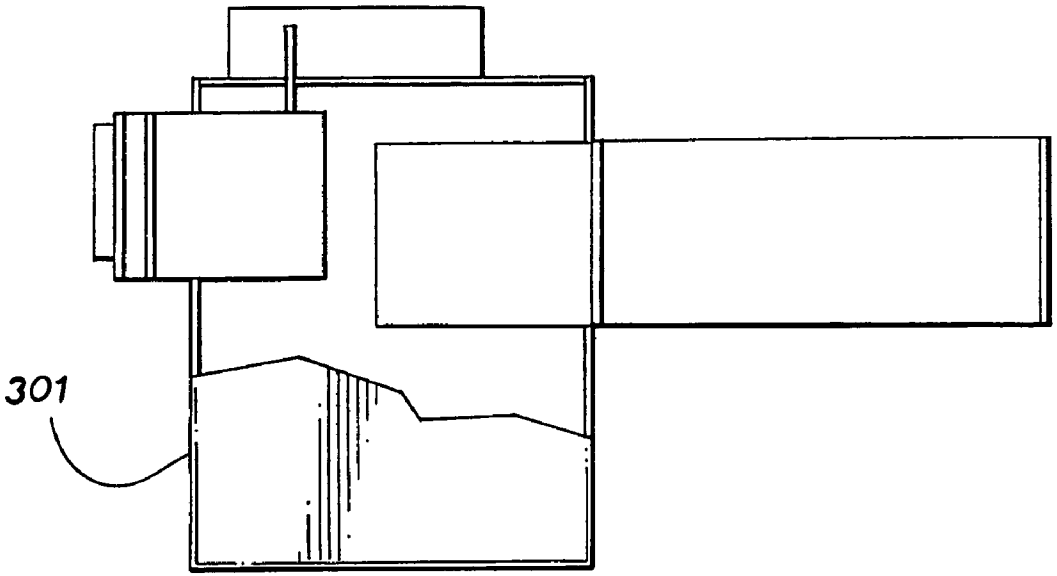
FIG. 3A PRIOR ART
FIG. 3A is a top cut away view of a prior art FPTU coupled to a prior art silencer.
Figure 3B:
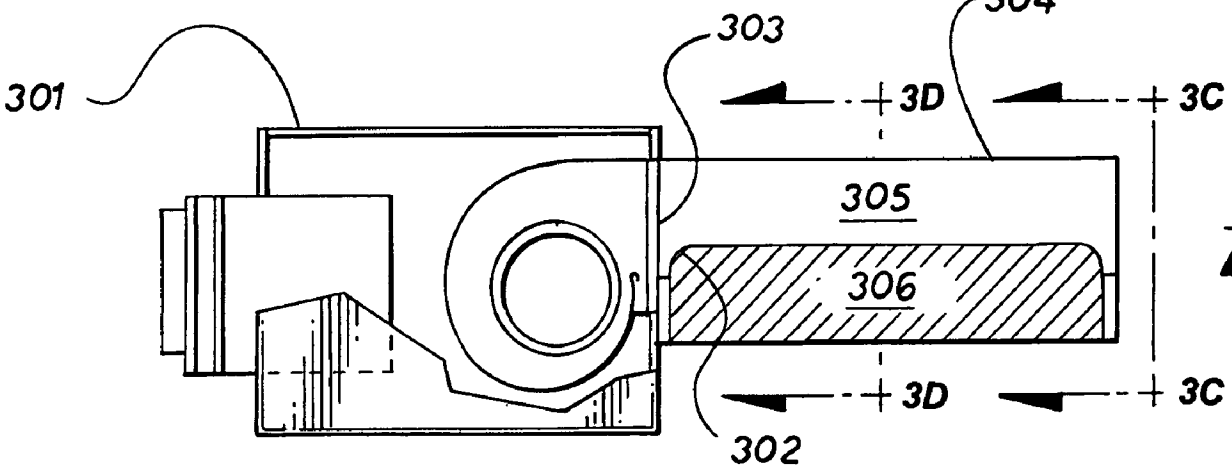
FIG. 3B PRIOR ART
FIG. 3B is a side cross-sectional view of FIG. 3A.

In addition, the cross-sectional area of the blower outlet 408 substantially equals the cross-sectional area of the air pathway 407 of the silencing portion 404 of the FPSTU 401. Therefore, the FPSTU 401 contains no nose, unlike the nose 209, 302 present in prior art silencers 202, 304 (FIGS. 2B, 3B).

Figures 4A, 4B, 4E:
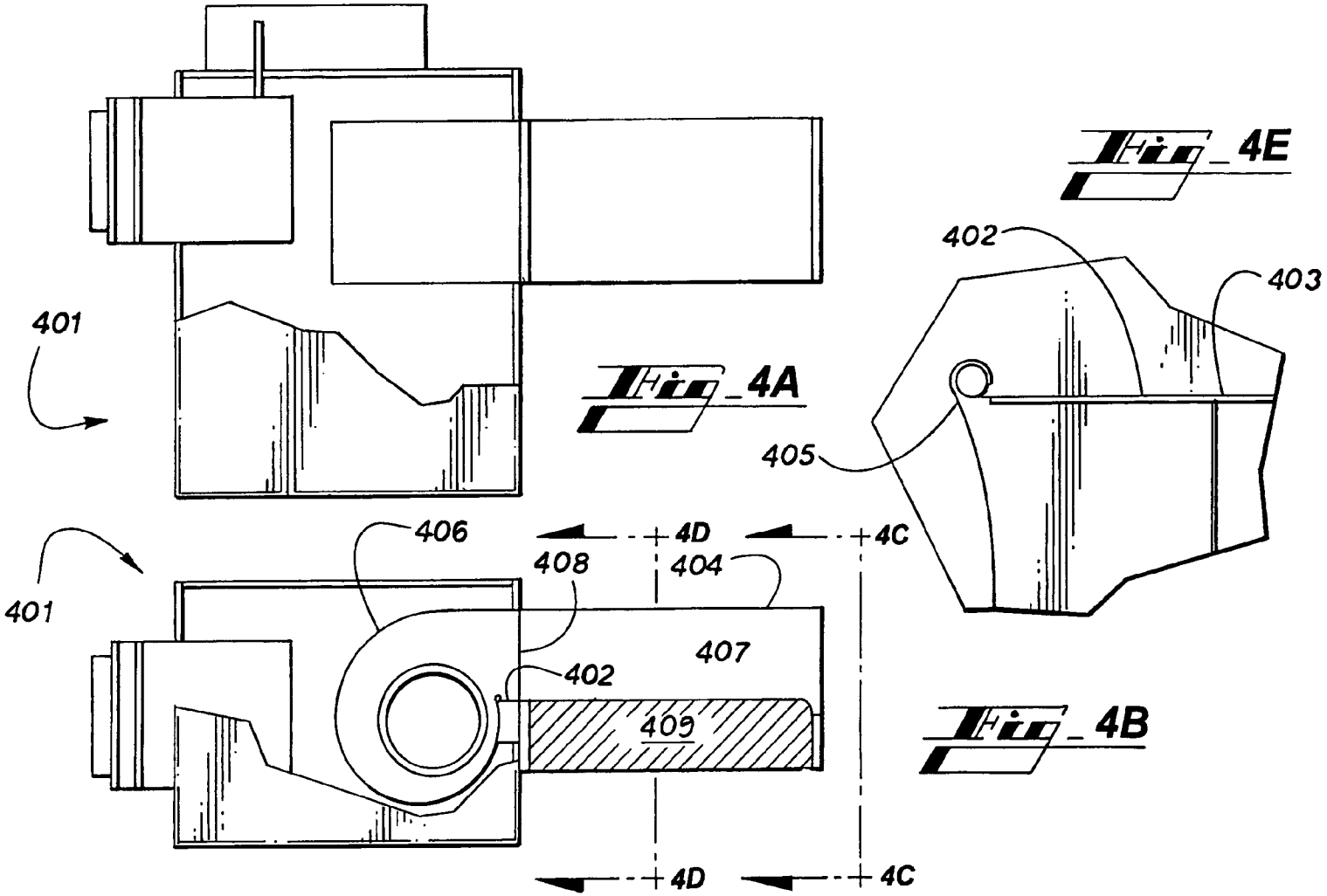
FIG. 4A is a top cut away view of an embodiment of an FPSTU in accordance with the invention.
FIG. 4B is a side cross-sectional view of FIG. 4A.
FIG. 4E is a magnified cross-sectional view of inset 4E of FIG. 4B.
Figures 4C, 4D, 5C, 5D:
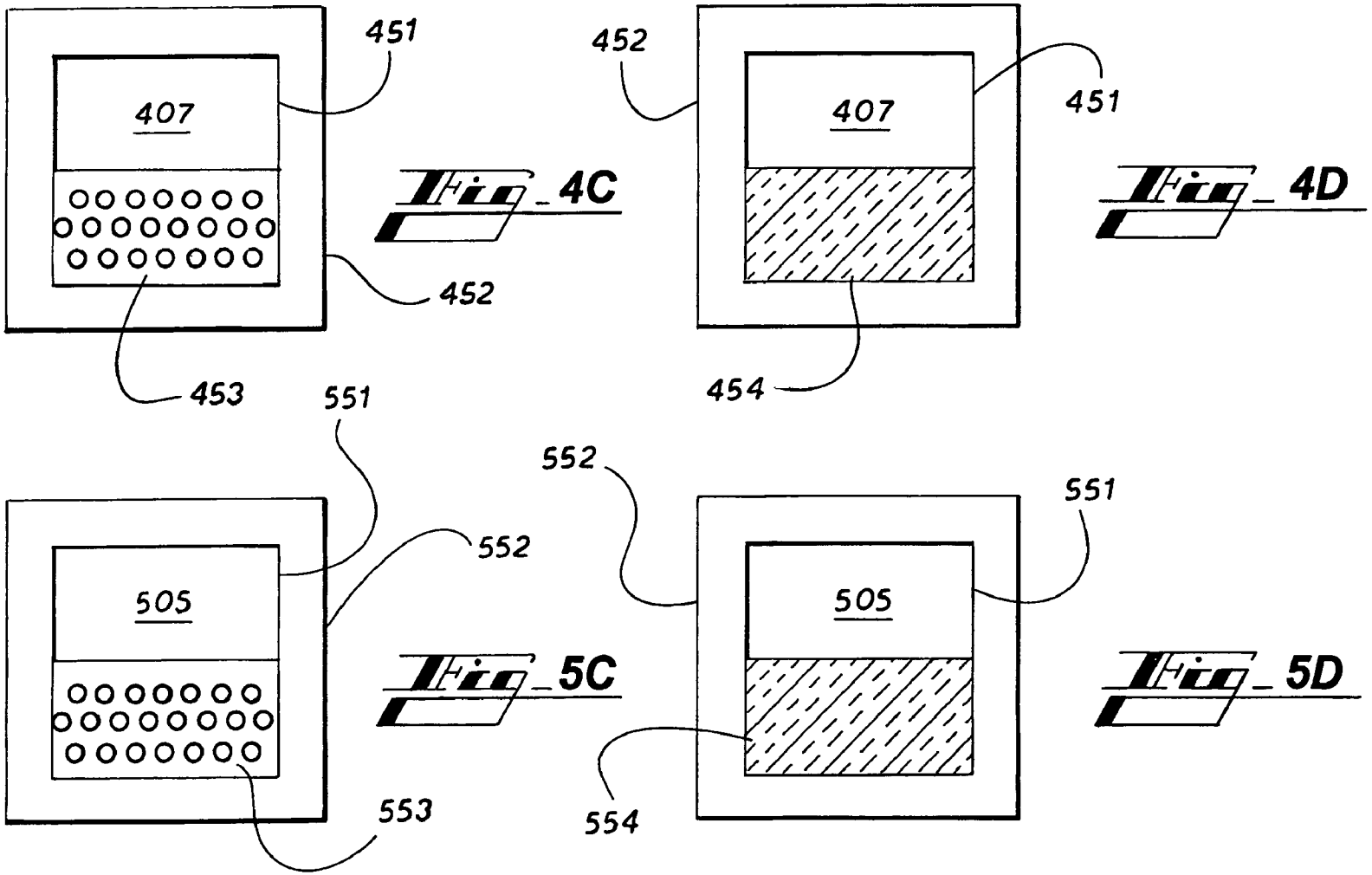
FIG. 4C is an end view along line 4C of FIG. 4B.
FIG. 4D is a cross-sectional view along line 4D of FIG. 4B.
FIG. 5C is an end view along line 5C of FIG. 5B.
FIG. 5D is a cross-sectional view along line 5D of FIG. 5B.
Figures 5A, 5B, 5E:
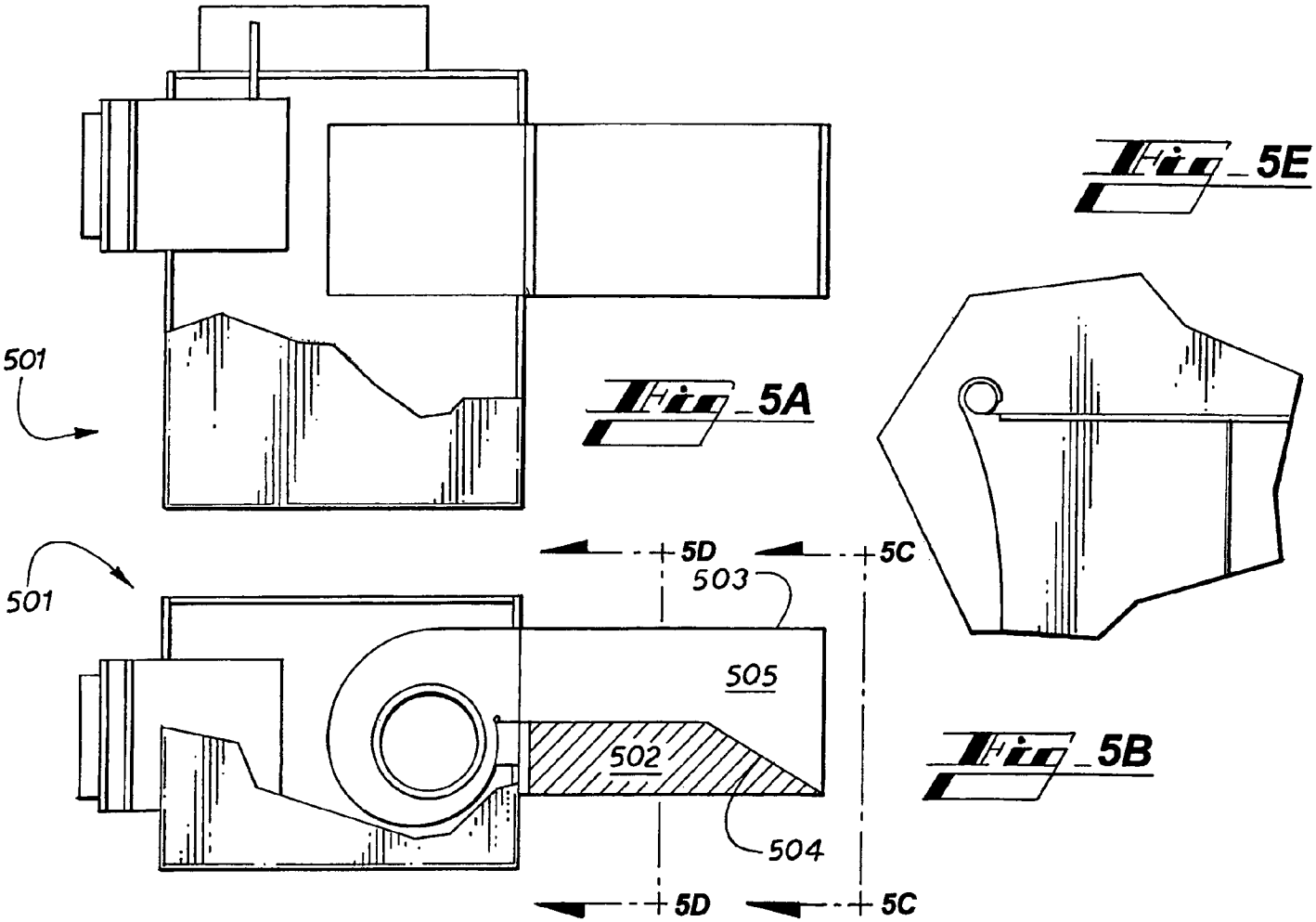
FIG. 5A is a top cut away view of an embodiment of an FPSTU in accordance with the invention.
FIG. 5B is a side cross-sectional view of FIG. 5A.
FIG. 5E is a magnified cross-sectional view of inset 5E of FIG. 5B.
Figures 6A, 6B, 6E:
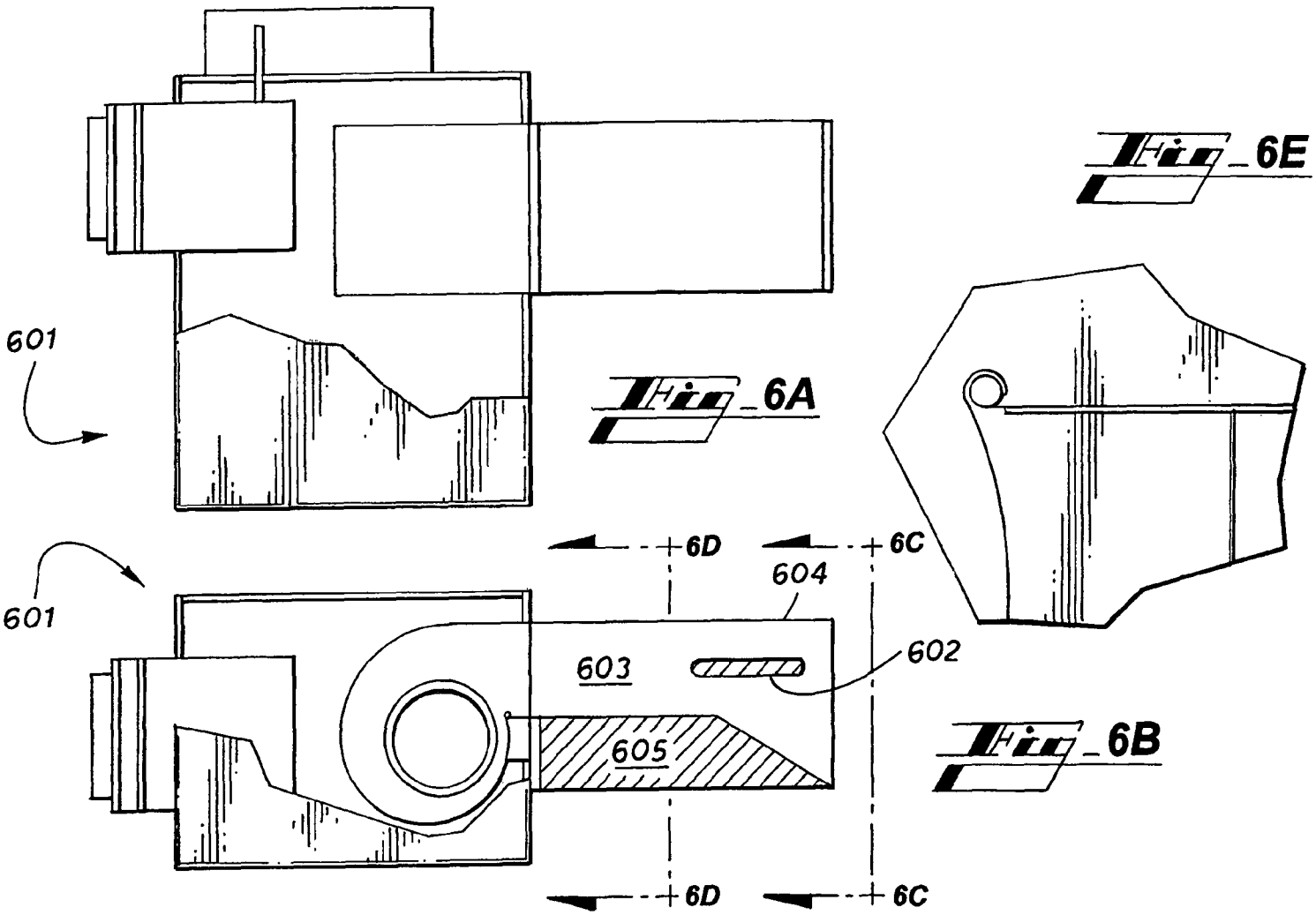
FIG. 6A is a top cut away view of an embodiment of an FPSTU in accordance with the invention.
FIG. 6B is a side cross-sectional view of FIG. 6A.
FIG. 6E is a magnified cross-sectional view of inset 6E of FIG. 6B.
Figures 7A, 7B, 7E:
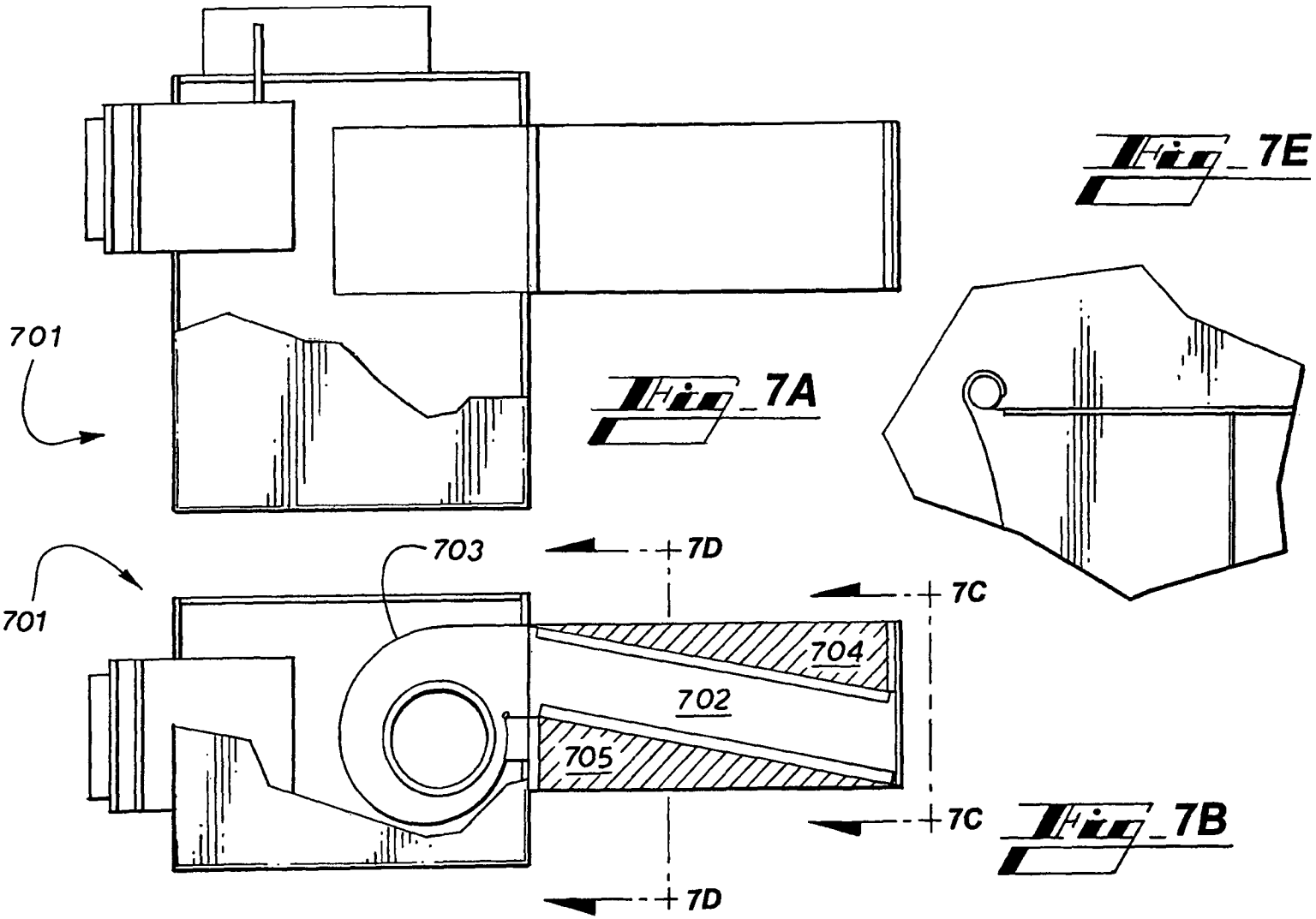
FIG. 7A is a top cut away view of an embodiment of an FPSTU in accordance with the invention.
FIG. 7B is a side cross-sectional view of FIG. 7A.
FIG. 7E is a magnified cross-sectional view of inset 7E of FIG. 7B.

FIG. 4C depicts an end view of the FPSTU 401 and the perforated metal casing 453 that encloses the insulating material 454 of the baffle 409. FIG. 4C also shows the casing 451 of the silencing portion 404 of the FPSTU 401 and the casing 452 of the plenum portion of the FPSTU 401.

FIG. 4D depicts a cross-sectional view of the insulating material 454 that comprises the baffle 409 of the silencing portion 404 of the FPSTU 401. FIG. 4D also shows the casing 451 of the silencing portion 404 of the FPSTU 401 and the casing 452 of the plenum portion of the FPSTU 401.

FIGS. 5A-5E illustrate an embodiment of the invention wherein the baffle 502 of the silencing portion 503 of the FPSTU 501 flares outward in a "tail" 504. This tail 504 allows the expanding air that is traveling down the air pathway 505 to maintain a constant pressure. This is because the increased cross-sectional area of the tail portion 504 of the FPSTU 501 provides additional space for the expanding air to occupy, thus preventing a buildup of pressure within the FPSTU 501.

FIG. 5C depicts an end view of the FPSTU 501 and the perforated metal casing 553 that encloses the insulating material 554 of the baffle 502. FIG. 5C also shows the casing 551 of the silencing portion 503 of the FPSTU 501 and the casing 552 of the plenum portion of the FPSTU 501.

FIG. 5D depicts a cross-sectional view of the insulating material 554 that comprises the baffle 502 of the silencing portion 503 of the FPSTU 501. FIG. 5D also shows the casing 551 of the silencing portion 503 of the FPSTU 501 and the casing 552 of the plenum portion of the FPSTU 501.

FIGS. 6A-6E illustrate an embodiment of the invention with a high-frequency splitter 602 placed in the air pathway 603 of the FPSTU 601. The high-frequency splitter 602 scatters high-frequency sound waves that would otherwise pass relatively unobstructed through the air pathway 603 due to the "beaming" effect of high-frequency sound. The scattered high-frequency sound waves will therefore tend to impact the baffle 605 directly or bounce off the casing 604 and then into the baffle 605, which will attenuate the sound.

FIG. 6C depicts an end view of the FPSTU 601 and the perforated metal casing 653 that encloses the insulating material 654 of the baffle 605. FIG. 6C also shows an end view of the high-frequency splitter 602. FIG. 6C also shows the casing 651 of the silencing portion of the FPSTU 601 and the casing 652 of the plenum portion of the FPSTU 601.

FIG. 6D depicts a cross-sectional view of the insulating material 654 that comprises the baffle 605 of the silencing portion of the FPSTU 601. FIG. 6D also shows the casing 651 of the silencing portion of the FPSTU 601 and the casing 652 of the plenum portion of the FPSTU 601.

FIGS. 7A-7E depict an embodiment of the invention wherein the air pathway 702 of the FPSTU 701 is angled or curved, thus minimizing or eliminating the line-of-sight pathway from the centrifugal fan 703 to the discharge outlet of the FPSTU 701. This elimination of the line-of-sight pathway will likewise minimize the high-frequency noise emitted by the centrifugal fan 703 and prevent high-frequency sound waves from traveling down the air pathway 702 unobstructed. The silencing portion of the FPSTU 701 can be up to five feet in length with an optimal length of three feet or less.

FIG. 7C depicts an end view of the FPSTU 701 and the perforated metal casing 753 that encloses the insulating material 754 of the angled top baffle 704. FIG. 7C also shows the casing 751 of the silencing portion of the FPSTU 701 and the casing 752 of the plenum portion of the FPSTU 701.

FIG. 7D depicts a cross-sectional view of the insulating material 754 that comprises the top and bottom baffles 704, 705 of the silencing portion of the FPSTU 701. FIG. 7D also shows the casing 751 of the silencing portion of the FPSTU 701 and the casing 752 of the plenum portion of the FPSTU 701.

While this invention has been described with reference to the structures and processed disclosed, it is to be understood that variations and modifications can be affected within the spirit and scope of the invention as described herein and as described in the appended claims.

We claim:

1. A fan powered silencing terminal unit comprising:

a centrifugal fan;

a housing comprising a cutoff plate and a blower outlet and containing said centrifugal fan;

a first casing comprising a plenum and said housing, said first casing containing an inlet and an outlet;

a second casing comprising a silencing portion and containing at least one baffle, said second casing containing an inlet and an outlet;

wherein said blower outlet is connected to the outlet of said first casing;

wherein the outlet of said first casing is directly coupled to the inlet of said second casing;

wherein said silencing portion contains an air pathway;

wherein said at least one baffle comprises an edge;

wherein a silencer inlet extension connects said edge of said at least one baffle to the cutoff plate of said housing, and wherein said silencer inlet extension extends partially into the plenum; and wherein the air pathway of said silencing portion is angled or curved to substantially minimize the line-of-sight pathway from said blower outlet to the outlet of said silencing portion.

2. The fan powered silencing terminal unit of claim 1 wherein said silencing portion is five feet or less in length.

3. The fan powered silencing terminal unit of claim 1 wherein said silencer inlet extension comprises a substantially flat, rigid material.

4. The fan powered silencing terminal unit of claim 1 wherein the cross-sectional area of said blower outlet is substantially equal to the cross-sectional area of the outlet of said first casing;

wherein the cross-sectional area of the outlet of said first casing is substantially equal to the cross-sectional area of the inlet of said second casing; and wherein the cross-sectional area of the inlet of said second casing is substantially equal to the cross-sectional area of said air pathway.

5. The fan powered silencing terminal unit of claim 3 wherein the cross-sectional area of said blower outlet is substantially equal to the cross-sectional area of the outlet of said first casing;

wherein the cross-sectional area of the outlet of said first casing is substantially equal to the cross-sectional area of the inlet of said second casing; and wherein the cross-sectional area of the inlet of said second casing is substantially equal to the cross-sectional area of said air pathway.

* * * * *